United States Patent [19]

Inoue et al.

[11] 4,266,096

[45] May 5, 1981

[54] AUDIBLE OUTPUT DEVICE FOR TALKING TIMEPIECES, TALKING CALCULATORS AND THE LIKE

[75] Inventors: Tomohiro Inoue; Sigeaki Masuzawa, both of Nara, Japan

[73] Assignee: Sharp Kabushiki Kaisha, Osaka, Japan

[21] Appl. No.: 98,064

[22] Filed: Nov. 28, 1979

[30] Foreign Application Priority Data

Nov. 30, 1978 [JP] Japan ..... 53-148940

[51] Int. Cl.[3] ..... G10L 1/00

[52] U.S. Cl. ..... 179/1.5 M; 364/710; 368/63

[58] Field of Search ..... 179/1.5 M, 1.5 A; 364/200, 900, 710; 340/148, 149; 58/23 R; 368/63

[56] References Cited

U.S. PATENT DOCUMENTS

| | | | |
|---|---|---|---|
| 3,704,345 | 11/1972 | Coker et al. | 179/1.5 M |
| 3,998,045 | 12/1976 | Lester | 364/710 |
| 4,016,540 | 4/1977 | Hyatt | 179/1.5 M |
| 4,185,169 | 1/1980 | Tanimoto et al. | 179/1.5 M |

*Primary Examiner*—Charles E. Atkinson
*Assistant Examiner*—E. S. Kemeny
*Attorney, Agent, or Firm*—Birch, Stewart, Kolasch & Birch

[57] ABSTRACT

An audible output device useful in timepiece or calculator devices, features a prestored and preselected order of digital codes representing speech words and pauses, to be outputted through gate circuitry responsive to the pause codes.

4 Claims, 5 Drawing Figures

AUDIBLE OUTPUT DEVICE FOR TALKING TIMEPIECES, TALKING CALCULATORS AND THE LIKE

BACKGROUND OF THE INVENTION

This invention relates to an audible output device implemented with solid state electronics and more particularly to a new control for establishing one or more audible output pause time slots (or silence slots) in the middle of the delivery of an audible output.

There has been a great trend to develop talking calculators, talking timepieces and the like, the talking calculators being generally adapted to provide numerical information such as key entries and calculation results as well as warning of error in the form of audible sounds and the talking timepieces being adapted to announce the real-time in audible sounds. For example, when electronic type talking timepiece provides an audible display of "tadaima kara 5 ji 25 fun wo oshirase shimasu"(its English version is "this is to announce that it is now 5:25"), it is necessary to locate a predetermined length of pause slots between "tadaima"and "kara", "kara" and "5 ji" and so forth.

OBJECTS AND SUMMARY OF THE INVENTION

Accordingly, it is an object of the present invention to provide a control appropriate to an audible output device implemented with solid state electronics for locating a desired number of pause or silent slots of time in the course of the delivery of audible messages of time. A main feature of the present invention resides in that pause codes are set up to locate these pause or silent slots during the delivery of a full-length audible message of updated time, the pause codes being capable of being handled in a similar manner to linguistic information codes indicative of words to be audibly displayed (e.g., "tadaima", "kara", "go", "ji", etc.). More particularly, an audible output device according to the present invention comprises a store means for storing the linguistic information codes indicative of words to be audibly displayed, a first control means for fetching the linguistic information codes in preselected order from the store means, an audible output means responsive to the first control means for delivering audible words in accordance with the linguistic information codes fetched from the store means, and a second control means operatively associated with the pause codes for allowing the pause codes to be stored within the store means together with the linguistic information codes and fetching the linguistic information codes and the pause codes from the store means in the preselected order of the words to be audibly displayed and the audible output pause time slots, and an audible output inhibition means responsive to the pause codes from the store means for disabling the audible output means for a desired length of time. Audible messages delivered from the audible output device are made as natural as everyday conversation because of varying lengths of the pauses as decided by the presence of the pause codes.

BRIEF DESCRIPTION OF THE DRAWINGS

For a more complete understanding of the present invention and for further objects and advantages thereof, reference is now made to the following description taken in conjunction with the accompanying drawings, in which.

DETAILED DESCRIPTION OF THE INVENTION

Figure 1B:
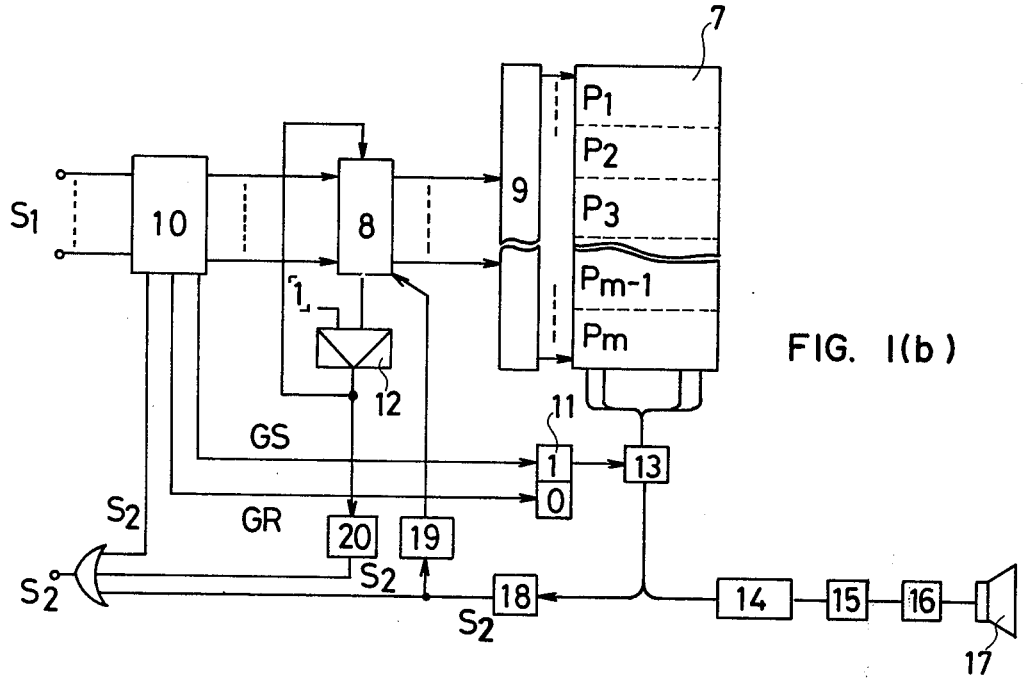
FIGS. 1(*a*) and 1(*b*) are schematic diagrams showing a principal configuration of a talking timepiece embodying the present invention.
Figure 1A:
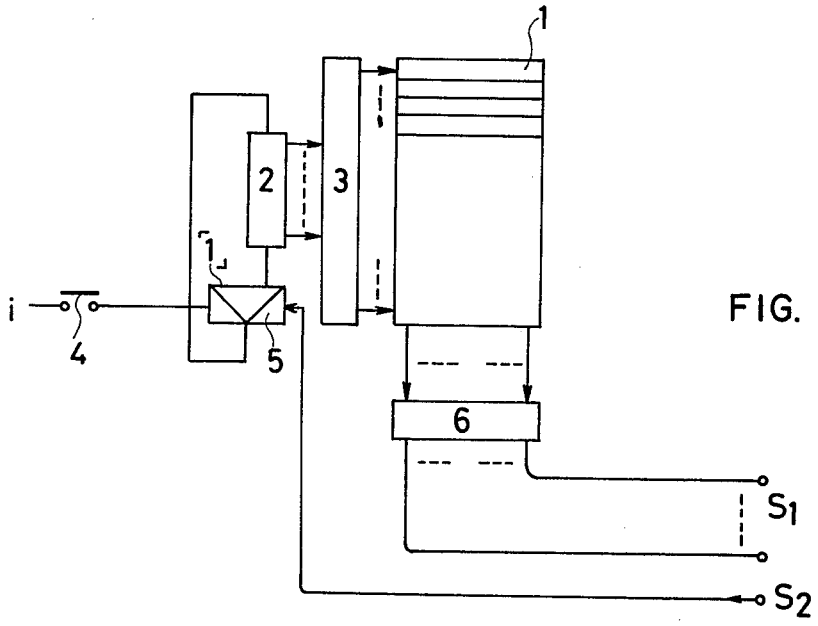

Referring now to FIGS. 1(*a*) and 1(*b*), there is illustrated schematic block diagrams showing a principal configuration of a talking timepiece embodying the present invention.

In one preferred embodiment of the present invention, linguistic information codes indicative of words to be audibly displayed (for example, "tadaima", "kara", "go", "ji", "ni", "jyu", "go", "fun", "wo", "oshirase", "shimasu", etc.) and pause codes necessary for the establishment of pause or silent slots are stored within an audible output information storage on the order in which the linguistic information codes and the pause codes should be delivered in sequence. In reply to the linguistic information codes and the pause codes, its corresponding audible outputs with desired pause periods or slots are delivered.

Each of the linguistic information codes and the pause codes is 8-bit long and the latter comprises a first half portion (upper 4 bits) indicative of the pause codes itself and a second half portion (lower 4 bits) indicative of the length of the pause periods. In other words, according to the above embodiment, the length of the respective pause periods is variable by modifying the contents of the second half portion of the pause codes.

Figures 2A, 2B:
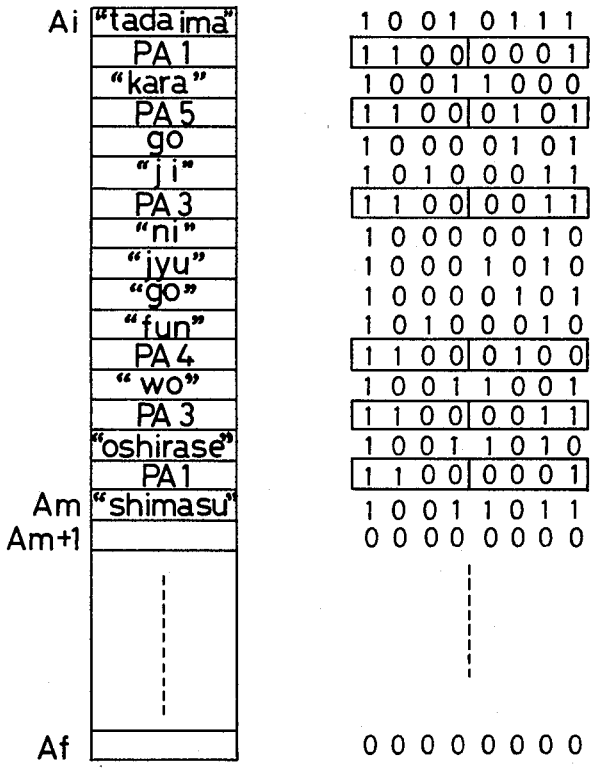
FIGS. 2(*a*) and 2(*b*) are an example of information contained within an audible output information storage of the talking timepiece shown in FIGS. 1(*a*) and 1(*b*)

An audible output storage 1 of FIG. 1(*a*) stores the linguistic information codes and the pause codes on the order in which they are outputted therefrom. The storage 1 may be implemented with either a read only memory where information is contained in a fixed manner or a read write memory where audible output information may be introduced therein by the use of a discrete control device whenever time to announce is approached. The above illustrated uses the latter. An example of information contained within the audible output storage 1 is depicted in FIGS. 2(*a*) and 2(*b*) wherein PA1 to PA5 represent the pause codes. As described above, the pause codes each comprises the first half portion ("1100" in the more significant 4 bits) indicative of the pause code itself and the second half portion ("0001", "0011", "0100", "0101", etc, in the less significant 4 bits) indicative of the length of the pause periods. Provided that P1 is the pause code indicative of the pause period of 200 msec long, PA3, PA4 and PA5 will be those indicative of the pause periods of 600 msec, 800 msec and 1 sec long. The initial address of the storage 1 is labeled Ai and the final address Af. In the illustrated example, the linguistic information code and the pause codes are stored in an address region beginning with the initial address Ai and ending with a specific intermediate address Am, while the remaining address region from $A_{m+1}$ up to Af is blank (that is, "00000000").

The audible output storage 1 has its peripheral circuits such as an address counter 2 and an address decoder 3. A switching device 4 for indicating that the delivery of audible outputs is to start is turned on in response to an audible output start signal and the like, loading the address counter 2 with the initial address and supplying an adder 5 with a start instruction signal. Upon receipt of the start instruction signal the adder 5 increments one the address counter 2 whenever an end signal $S_2$ is derived from an audible output control and an audible output pause control as will be discussed later, the end signal being developed when the delivery of the audible information outputs or the pause periods are completed. Each time the signal $S_2$ is developed the address of the output storage 1 is incremented step by step. An output buffer 6 temporarily stores the linguistic information codes and the pause codes derived from the audible output sorage 1 in response to the address specified by the addrees counter 2. The audible output control for allowing corresponding linguistic outputs to be delivered in sequence according to the contents output sequentially to the output buffer 6 is illustrated in FIG. 1(*b*) as well as the audible output pause control for prohibiting the audible outputs from being delivered in response to the pause codes outputted from the output buffer 6.

Figure 3:
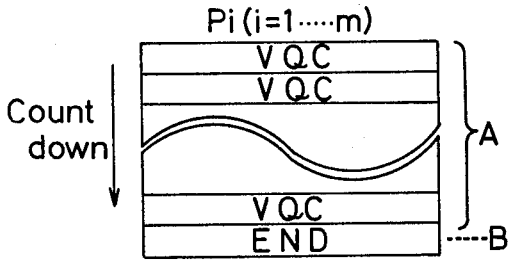
FIG. 3 shows the contents of a sound quantizing information storage in the above illustrated talking timepiece.

A sound quantizing information storage (read only memory) 7 is adapted to make verbal words corresponding to the linguistic information codes audible to human beings. In order to display a word in the form of audible sounds, it is necessary to provide a plurality of pieces of the sound quantizing information VQC. A first region A for storing the pieces of the sound quantizing informatin VQC on the order in which these pieces are to be delivered and a second region B for storing an end code located at a step following the final step of the first region. A form an information storage region for the audible voice delivery relating one word (see FIG. 3). The sound quantizing information storage 7 has an address counter 8 and an address decoder 9. A codes converter 10 provides an address selection signal (specifying the leading step of the region where information is stored for displaying words corresponding to the linguistic information codes output via the output buffer 6 in the form of audible sounds and particularly synthesized voices) for the address counter 8 and a reset signal GR for a flip-flop 11 under the direction of a signal $S_1$ developed from the output buffer 6 of the audible output information storage 1 when the signal $S_1$ is one of the linguistic information codes. The situation when the signal $S_1$ is the pause codes or the blank codes "00000000" will be described later. When the address selection signal from the code converter 10 is applied to the address counter 81 the address counter 8 is decremented by "1" at an appropriate interval of time. The decrementing of the address counter 8 is accomplished by a subtractor 12. Accordingly, when the address counter 8 receives the address selection signal, the sound quantizing information is derived in sequence beginning with the second leading step specified by the address selection signal. An output gate circuit 13 is provided for the sound quantizing information storage 7 and adapted to be turned on when the flip-flop 11 is in the reset state (in other words, when the information applied to the code converter 10 is one of the linguistic information codes). A digital-to-analog converter 14 converts the sound quantizing information supplied via the output gate circuit 13 into corresponding analog signals. A low-pass filter 15 receives the output of the digital-to-analog converter 14 and passes only its low frequency components. A speaker driver 16 receives the output from the low-pass filter 15 and drives a loud speaker 17 for the delivery of audible outputs.

The reason why the low-pass filter 15 is provided is that, when the analog output converted from the sound quantizing information is stepwise, this will cause noisy or harsh sounds due to its high frequency components as long as the analog output is applied directly to the loud speaker 17.

An end code detector 18 senses the end code from the sound quantizing information storage 7 and develops the end signal $S_2$. The end signal $S_2$, as described previously, is supplied to the adder 5 to increment the address counter 2 of the audible output storage 1 by one and is also supplied to the reset circuit 19 for resetting the address counter 8, thus terminating the delivery of the audible sounds. With the address counter 8 in the reset state, the sound quantizing information storage 7 is neither addressed nor does the subtractor 12 operate for decrementing operation. With such an arrangement, the audible sounds indicative of selected words are delivered according to the linguistic information storage codes from the audible output storage 1.

In the case where the information derived from the audible output storage 1 is in agreement with the pause codes, the length of the pause periods where the audible outputs are prohibited is determined in the following manner. When the output signal $S_1$ from the output buffer 6 of the audible output storage 1 is in the pause codes, the code converter 10 supplies the set signal GS to the flip-flop 11. The output gate circuit 13 of the sound quantizing information storage 7 is closed to inhibit the transmission of the sound quantizing information therefrom. The code converter 10 decodes the lower 4 bits (specifying the length of the pause periods) of the pause codes into its corresponding codes which in turn are supplied to the address counter 8 for decrementing the same by one. The information stored at the address of the sound quantizing informatin storage 7 as specified by the count of the address counter 8 is sequentially derived. However, since the output gate circuit 13 is closed, any audible output is not provided. An address counter detector 20 senses if the count of the address counter 8 reduces to "0" and, if so, supplies the signal $S_2$ to the adder 5 to increment the working address of the audible output storage 1 by one. For example, provided that the decrementing of the address counter 8 is achieved "N" for a period of time of 200 msec, the code converter 10 supplies the code signal indicative of "N" to the address counter 8 when the pause codes are PA1. When the pause codes are PA2, PA3, PA4, PA5 . . . , the code signals indicative of "2N", "3N", "4N" and "SN" are likewise supplied to the address counter 8. The above procedure puts a temporary stop to the delivery of the audible sounds. Moreover, when the code output from the audible output storage 1 is blank, the code converter 10 supplies the end signal $S_2$.

The above disclosed arrangement will operate as follows: When the switching device 4 is turned on, the address counter 2 is loaded with the initial address for the audible output storage 1. If the count of the address counter 2 agrees with the file address of the storage 1, then the address counter will overflow and return to "0". With the switching device 4 in the on state, the initial address Ai of the audible output storage 1 is selected so that the linguistic information codes "10010111" indicative of "tadaima" are supplied to the output buffer register 6. In reply to those codes the code converter 10 supplies the leading address identifying signal to the address counter 8 in relation to the region where the sound quantizing information is contained for the audible sounds "tadaima". Thus, the sounds "tadaima" are delivered. Upon the completion of the delivery of that audible sounds the adder 5 receives the signal $S_2$ to increment one the count of the address counter 2. When this occurs, the pause codes PA1 "11000001" are supplied to the output buffer register 6 to initiate the silent period of 200 msec long. Then, the adder 5 receives the signal $S_2$ and increments by one the count of the address counter 2 so that the linguistic information codes "10011000" indicative of "kara" are output from the output buffer register 6.

Through the above mentioned events the audible sounds "tadaima kara goji nijyugofun wo ashirase-shimasu" are delivered.

While in the above illustrated embodiment the switching device 4 is turned on by the sound output start signal automatically developed within the interior of the timepiece, it may be turned on manually in the practice of the present invention.

Since the length of the pause periods is variable by a proper selection of the contents of the second half (lower 4 bits) of the pause codes, the speed of the voice delivery is also variable according to the contents to be announced by a proper selection of the second half of the pause codes.

The pause codes are effective in establishing a short pause during the delivery of a double consonant such as "ippun" and "roppun" in addition to the above illustrated example. By way of an example of "ippun" or "roppun" the pause codes PA may be interposed between the linguistic information "i" or "ro" and the linguistic information "pun". Although in the above embodiment, the pause codes of different kinds are provided for the establishment of pause periods of different lengths, only one pause code may be rather employed to establish phase periods of the fixed length and a combination of a plurality of the common pause code used for a pause period of any desirable length.

Whereas the present invention has been described with respect to specific embodiments thereof, it will be understood that various changes and modifications will be suggested to one skilled in the art, and it is intended to encompass such changes and modifications as fall within the scope of the appended claims.

We claim:

1. An audible output device comprising:

a store means for storing linguistic information codes indicative of words to be audibly displayed;

a first control means for fetching the linguistic information codes in preselected order from the store means;

an audible output means responsive to the first control means for deliverying audible words in accordance with the linguistic information codes fetched from the store means;

a second control means operatively associated with a pause code for allowing the pause code to be stored within the store means together with the linguistic information codes and fetching the linguistic information codes and the pause code from the store means in the preselected order of the words to be audibly displayed and the audible output pause time slots;

and an audible output inhibition means responsive to the pause codes from the store means for disabling the audible output means for a desired length of time.

2. An audible output device according to claim 1, wherein said linguistic information is indicative of updated time for timepiece use.

3. An audible output device according to claim 1, wherein said linguistic information is indicative of an input or an output for calculator use.

4. An audible output device according to claim 1, further comprising a second store means interposed between said store means and said audible output means for storing sound quantizing information associated with the respective linguistic information codes.

* * * * *